US008387662B2

(12) United States Patent
Dykstra et al.

(10) Patent No.: US 8,387,662 B2
(45) Date of Patent: Mar. 5, 2013

(54) DEVICE FOR DIRECTING THE FLOW OF A FLUID USING A PRESSURE SWITCH

(75) Inventors: Jason D. Dykstra, Carrollton, TX (US); Michael L. Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 229 days.

(21) Appl. No.: 12/958,625

(22) Filed: Dec. 2, 2010

(65) Prior Publication Data

US 2012/0138304 A1 Jun. 7, 2012

(51) Int. Cl.
*F15B 1/08* (2006.01)
*F15C 1/08* (2006.01)

(52) U.S. Cl. ..... 137/813; 137/841

(58) Field of Classification Search ..... 137/803, 137/807, 808, 812, 813, 825, 841
See application file for complete search history.

(56) References Cited

U.S. PATENT DOCUMENTS

| | | | | |
|---|---|---|---|---|
| 3,266,510 | A * | 8/1966 | Wadey | 137/836 |
| 3,486,975 | A * | 12/1969 | Ripley | 376/230 |
| 3,566,900 | A | 3/1971 | Black | |
| 3,575,804 | A * | 4/1971 | Ripley | 376/229 |
| 3,586,104 | A | 6/1971 | Hyde | |
| 3,620,238 | A | 11/1971 | Kawabata | |
| 3,712,321 | A | 1/1973 | Bauer | |
| 4,276,943 | A | 7/1981 | Holmes | |
| 4,323,991 | A | 4/1982 | Holmes et al. | |
| 4,418,721 | A | 12/1983 | Holmes | |
| 4,557,295 | A | 12/1985 | Holmes | |
| 4,895,582 | A | 1/1990 | Bielefeldt | |
| 5,076,327 | A | 12/1991 | Mettner | |
| 6,497,252 | B1 | 12/2002 | Kohler et al. | |
| 7,828,067 | B2 | 11/2010 | Scott et al. | |
| 2002/0150483 | A1 | 10/2002 | Ursan et al. | |
| 2009/0120647 | A1 | 5/2009 | Turick et al. | |
| 2010/0122804 | A1 | 5/2010 | Yang | |

(Continued)

FOREIGN PATENT DOCUMENTS

| | | | |
|---|---|---|---|
| EP | 0132923 | A2 | 2/1985 |
| WO | WO 2010053378 | A2 | 5/2010 |

(Continued)

OTHER PUBLICATIONS

Angrist, Fluid Control Devices, Scientific American, Dec. 1964, pp. 80-88, USA.

(Continued)

*Primary Examiner* — Craig Schneider
(74) *Attorney, Agent, or Firm* — Paul Herman; Sheri Higgins Law

(57) ABSTRACT

A device for directing the flow of a fluid comprises: a pressure pocket; a first fluid passageway; a pressure source; and a pressure switch, wherein the first fluid passageway operationally connects at least the pressure pocket and the pressure source, and wherein the pressure switch is positioned adjacent to the pressure source. According to an embodiment, depending on at least one of the properties of the fluid, the fluid that flows into the pressure pocket changes. In one embodiment, the change is the fluid increasingly flows into the pressure pocket. In another embodiment, the change is the fluid decreasingly flows into the pressure pocket. According to another embodiment, a flow rate regulator comprises: the device for directing the flow of a fluid; a second fluid passageway; a third fluid passageway; and a fourth fluid passageway.

45 Claims, 5 Drawing Sheets

U.S. PATENT DOCUMENTS

| | | | |
|---|---|---|---|
| 2010/0181251 | A1 | 7/2010 | Alspektor |
| 2011/0042092 | A1 | 2/2011 | Fripp et al. |
| 2011/0198097 | A1 | 8/2011 | Moen |

FOREIGN PATENT DOCUMENTS

| | | | |
|---|---|---|---|
| WO | WO 2010087719 | A1 | 8/2010 |
| WO | WO 2011041674 | A2 | 4/2011 |
| WO | WO 2011095512 | A2 | 8/2011 |
| WO | WO 2011115494 | A1 | 9/2011 |

OTHER PUBLICATIONS

Wright et al., The Development and Application of HT/HP Fiber Optic Connectors for Use on Subsea Intelligent Wells, OTC 15323, May 2003, pp. 1-8, For Presentation in 2003 OTC Conference in Houston, Texas, USA.

Freyer et al., An Oil Selective Inflow Control System, SPE 78272, Oct. 2002, pp. 1-8, For Presentation in 2002 SPE Conference in Aberdeen, Scotland, U.K.

* cited by examiner

DEVICE FOR DIRECTING THE FLOW OF A FLUID USING A PRESSURE SWITCH

TECHNICAL FIELD

A device for directing the flow of a fluid is provided. In certain embodiments, the device is used in a system having at least two fluid passageways with a similar back pressure. According to an embodiment, the system is a flow rate regulator. According to another embodiment, the flow rate regulator is used in a subterranean formation.

SUMMARY

According to an embodiment, a device for directing the flow of a fluid comprises: a pressure pocket; a first fluid passageway; a pressure source; and a pressure switch, wherein the first fluid passageway operationally connects at least the pressure pocket and the pressure source, and wherein the pressure switch is positioned adjacent to the pressure source. In some embodiments, depending on at least one of the properties of the fluid, the fluid that flows into the pressure pocket changes. According to these embodiments, the at least one of the properties of the fluid are selected from the group consisting of the flow rate of the fluid in a second fluid passageway, the viscosity of the fluid, and the density of the fluid.

According to another embodiment, the shape of the pressure pocket is selected such that: as the flow rate of the fluid in the second fluid passageway decreases, the fluid increasingly flows into the pressure pocket; and as the flow rate of the fluid in the second fluid passageway increases, the fluid decreasingly flows into the pressure pocket.

According to another embodiment, a desired flow rate of a fluid is predetermined, and when the flow rate of the fluid in a second fluid passageway decreases below the predetermined flow rate, the fluid increasingly flows into the pressure pocket compared to when the flow rate of the fluid in the second fluid passageway increases above the predetermined flow rate.

According to another embodiment, a flow rate regulator comprises: the device for directing the flow of a fluid; a second fluid passageway; a third fluid passageway; and a fourth fluid passageway, wherein as at least one of the properties of the fluid changes, the fluid that flows into the pressure pocket changes.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
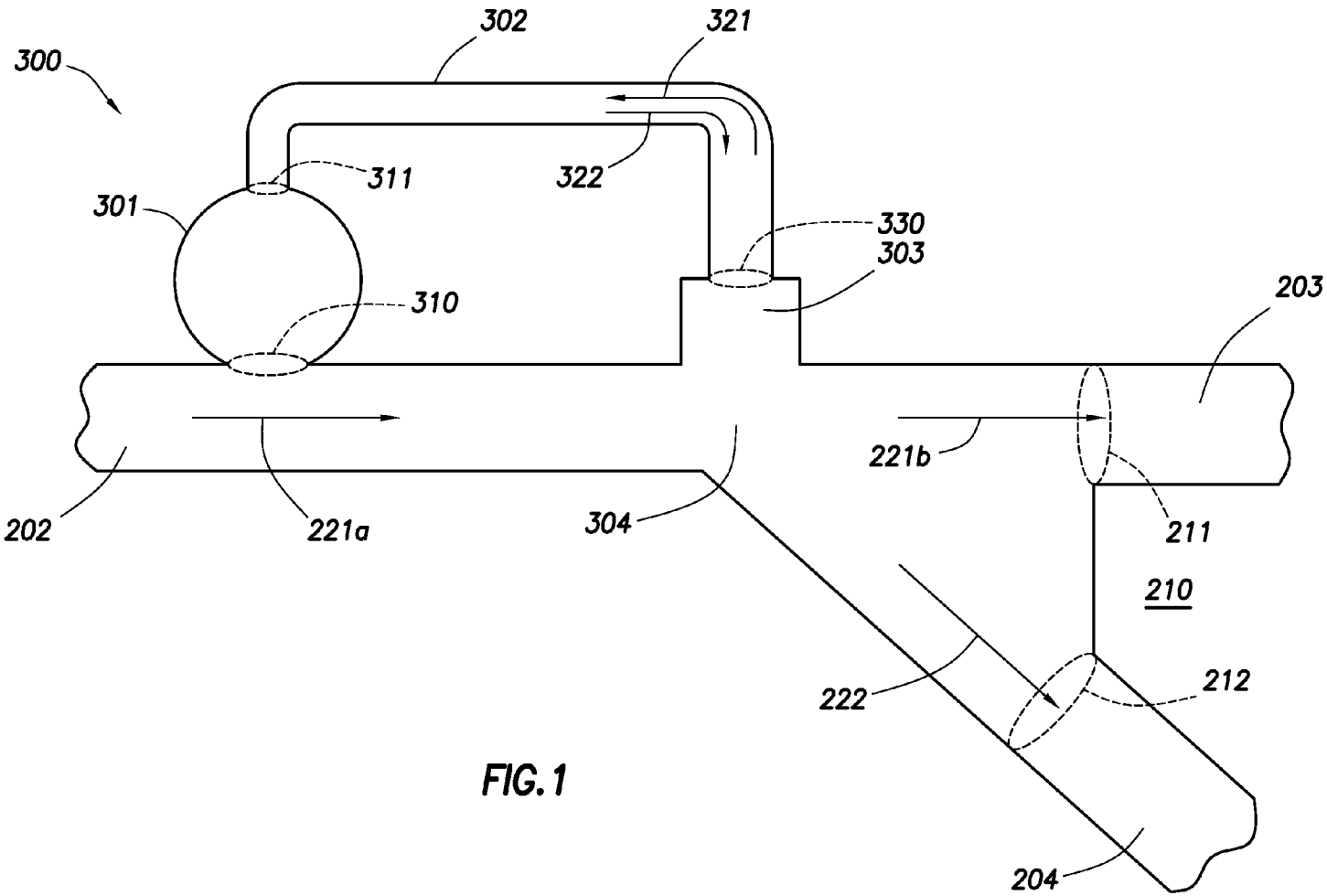
FIG. 1 is a diagram of a device for directing the flow of a fluid.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more passageways, inlets, etc., as the case may be, and does not indicate any sequence. Furthermore, it is to be understood that the mere use of the term "first" does not require that there be any "second," and the mere use of the term "second" does not require that there be any "third," etc.

As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, water, or injection well. A well used to produce oil or gas is generally referred to as a production well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. As used herein, "into a well" means and includes into any portion of the well, including into the wellbore or into a near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore which can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

A wellbore can extend several hundreds of feet or several thousands of feet into a subterranean formation. The subterranean formation can have different zones. For example, one zone can have a higher permeability compared to another zone. Permeability refers to how easily fluids can flow through a material. For example, if the permeability is high, then fluids will flow more easily and more quickly through the subterranean formation. If the permeability is low, then fluids will flow less easily and more slowly through the subterranean formation. One example of a highly permeable zone in a subterranean formation is a fissure or fracture.

During production operations, it is common for an undesired fluid to be produced along with the desired fluid. For example, water production is when water (the undesired fluid) is produced along with oil or gas (the desired fluid). By way of another example, gas may be the undesired fluid while oil is the desired fluid. In yet another example, gas may be the desired fluid while water and oil are the undesired fluid. It is beneficial to produce as little of the undesired fluid as possible.

During secondary recovery operations, an injection well can be used for water flooding. Water flooding is where water is injected into the reservoir to displace oil or gas that was not produced during primary recovery operations. The water from the injection well physically sweeps some of the remaining oil or gas in the reservoir to a production well.

In addition to the problem of undesired fluid production during recovery operations, the flow rate of a fluid from a subterranean formation into a wellbore may be greater in one zone compared to another zone. A difference in flow rates between zones in the subterranean formation may be undesirable. For an injection well, potential problems associated with water flooding techniques can include inefficient recovery due to variable permeability in a subterranean formation and difference in flow rates of a fluid from the injection well into the subterranean formation. A flow rate regulator can be used to help overcome some of these problems.

A flow rate regulator can be used to deliver a relatively constant flow rate of a fluid within a given zone. A flow rate regulator can also be used to deliver a relatively constant flow rate of a fluid between two or more zones. For example, a regulator can be positioned in a wellbore at a location for a particular zone. More than one regulator can be used for a particular zone. Also, a regulator can be positioned in a wellbore at one location for one zone and another regulator can be positioned in the wellbore at one location for a different zone.

A novel device for directing the flow of a fluid uses changes in pressure to cause a pressure switch to direct the flow of the fluid into two different fluid passageways. According to an embodiment, the device is for use in a system where the two different fluid passageways have a similar back pressure. In another embodiment, the system is a flow rate regulator. As used herein, the phrase "similar back pressure" means that the back pressure of the two different passageways is within +/−25% of each other, is within 25 pounds force per square inch (psi) of each other, or is within 25% of the total pressure drop through the system. By way of example, the two different fluid passageways can have a cross-sectional area that is +/−25% of each other when the length of the passageways are the same. By way of another example, if the cross-sectional areas are different, then the lengths of the two fluid passageways can be adjusted such that the back pressure is within +/−25%.

According to an embodiment, a device for directing the flow of a fluid comprises: a pressure pocket; a first fluid passageway; a pressure source; and a pressure switch.

The fluid can be a homogenous fluid or a heterogeneous fluid.

Turning to the Figures. FIG. 1 is a diagram of the device for directing the flow of the fluid 300. The device 300 includes a pressure pocket 301, a first fluid passageway 302, a pressure source 303, and a pressure switch 304. As used herein, a "pressure pocket" means a volume surrounded by a structure, where the structure has at least two openings. The pressure pocket 301 can have a first opening 311 into the first fluid passageway 302 and a second opening 310 into the second fluid passageway 202. In an embodiment, the shape of the pressure pocket 301 can include the first opening 311 having the same diameter and cross section as the second opening 310. According to an embodiment, as at least one of the properties of the fluid changes, the fluid that flows into the pressure pocket changes. Preferably, the at least one of the properties of the fluid is selected from the group consisting of the flow rate of the fluid in a second fluid passageway 202, the viscosity of the fluid, and the density of the fluid. The fluid that flows into the pressure pocket can change. The change can be that the fluid increasingly flows into the pressure pocket. The change can also be that the fluid decreasingly flows into the pressure pocket.

According to an embodiment, the shape of the pressure pocket 301 is selected such that: as the flow rate of a fluid in the second fluid passageway 202 decreases, the fluid increasingly flows into the pressure pocket 301; and as the flow rate of the fluid in the second fluid passageway 202 increases, the fluid decreasingly flows into the pressure pocket 301. According to another embodiment, the shape of the pressure pocket 301 is selected such that: as the flow rate of a fluid in a second fluid passageway 202 decreases, the ratio of the fluid entering the pressure pocket 301 to fluid in the second fluid passageway 202 increases; and as the flow rate of the fluid in the second fluid passageway 202 increases, the ratio of the fluid entering the pressure pocket 301 to the fluid in the second fluid passageway 202 decreases. In a preferred embodiment, the shape of the pressure pocket 301 is circular, rounded, orbicular, or elliptical in shape. The figures show a single pressure pocket 301 but a plurality of pockets could be used.

According to another embodiment, the shape of the pressure pocket 301 is selected such that: as the viscosity of a fluid in a second fluid passageway 202 increases, the fluid increasingly flows into the pressure pocket 301; and as the viscosity of the fluid in the second fluid passageway 202 decreases, the fluid decreasingly flows into the pressure pocket 301. According to another embodiment, the shape of the pressure pocket 301 is selected such that: as the viscosity of a fluid in a second fluid passageway 202 increases, the ratio of the fluid entering the pressure pocket 301 to fluid in the second fluid passageway 202 increases; and as the viscosity of the fluid in the second fluid passageway 202 decreases, the ratio of the fluid entering the pressure pocket 301 to the fluid in the second fluid passageway 202 decreases.

According to another embodiment, the shape of the pressure pocket 301 is selected such that: as the density of a fluid in a second fluid passageway 202 decreases, the fluid increasingly flows into the pressure pocket 301; and as the density of the fluid in the second fluid passageway 202 increases, the fluid decreasingly flows into the pressure pocket 301. According to another embodiment, the shape of the pressure pocket 301 is selected such that: as the density of a fluid in a second fluid passageway 202 decreases, the ratio of the fluid entering the pressure pocket 301 to fluid in the second fluid passageway 202 increases; and as the density of the fluid in the second fluid passageway 202 increases, the ratio of the fluid entering the pressure pocket 301 to the fluid in the second fluid passageway 202 decreases.

The device 300 includes a first fluid passageway 302. The first fluid passageway 302 (and any other passageways) can be tubular, rectangular, pyramidal, or curlicue in shape. Although illustrated as a single passageway, the first fluid passageway 302 (and any other passageway) could feature multiple passageways connected in parallel. As illustrated in FIG. 1, the first fluid passageway 302 operationally connects at least one pressure pocket 301 and at least the pressure source 303. For example, the first fluid passageway 302 can be connected at one end to a pressure pocket 301 and connected at the other end to the pressure source 303. The first fluid passageway 302 can include a first fluid outlet 330. The first fluid passageway 302 can be connected at one end at the first opening 311 into the pressure pocket 301 and connected at the other end at the first fluid outlet 330 into the pressure source 303. The pressure switch 304 is preferably positioned adjacent to the pressure source 303 within the second fluid passageway 202. According to an embodiment, the pressure source 303 is the same size and cross section as the first fluid outlet 330.

The components of the device for directing the flow of a fluid 300 can be made from a variety of materials. Examples of suitable materials include, but are not limited to: metals, such as steel, aluminum, titanium, and nickel; alloys; plastics; composites, such as fiber reinforced phenolic; ceramics, such as tungsten carbide or alumina; elastomers; and dissolvable materials.

According to an embodiment, the device for directing the flow of a fluid 300 is used in a system having at least two different fluid passageways that have a similar back pressure. According to this embodiment, the system can include a second fluid passageway 202, a branching point 210, a third fluid passageway 203, and a fourth fluid passageway 204. In this illustration, the third and fourth fluid passageways 203 and 204 are the at least two different fluid passageways that have a similar back pressure with respect to the second fluid passageway 202. The fluid passageways in the system can be altered to provide varying back pressures. For example, the cross-sectional area of the second fluid passageway 202 at the juncture of the pressure pocket 301 can be altered larger or smaller to change the back pressure of the third and fourth fluid passageways 203 and 204 relative to the second fluid passageway 202.

As can be seen in FIG. 1, the second fluid passageway 202 can branch into the third and fourth fluid passageways 203 and 204 at the branching point 210. The second fluid passageway 202 can branch into the third and fourth fluid passageways 203 and 204 such that the third fluid passageway 203 branches at an angle of 180° with respect to the second fluid passageway 202. By way of another example, the third fluid passageway 203 can branch at a variety of angles other than 180° (e.g., at an angle of 45°) with respect to the second fluid passageway 202. The fourth fluid passageway 204 can also branch at a variety of angles with respect to the second fluid passageway 202. Preferably, if the third fluid passageway 203 branches at an angle of 180° with respect to the second fluid passageway 202, then the fourth fluid passageway 204 branches at an angle that is not 180° with respect to the second fluid passageway 202. At the branching point 210, the third fluid passageway 203 can include a second fluid inlet 211 and the fourth fluid passageway 204 can include a third fluid inlet 212. Although the third and fourth fluid passageways, 203 and 204, are the only two passageways shown in FIG. 1 having a similar back pressure, there is no limit to the number of different passageways that could be used.

The device for directing the flow of a fluid 300 can be used in any system. According to certain embodiments, the system comprises at least two different fluid passageways having a similar back pressure. An example of a system is a flow rate regulator 25, illustrated in FIGS. 3 and 4. The system can comprise: the device for directing the flow of a fluid 300; a second fluid passageway 202; a third fluid passageway 203; and a fourth fluid passageway 204. According to an embodiment, the third fluid passageway 203 and the fourth fluid passageway 204 have a similar back pressure. The system can further include a first fluid inlet 201. The system can also include an exit assembly 205 comprising a second fluid outlet 206. The system is shown comprising one device 300; however, the system can include more than one device 300.

Figure 4:
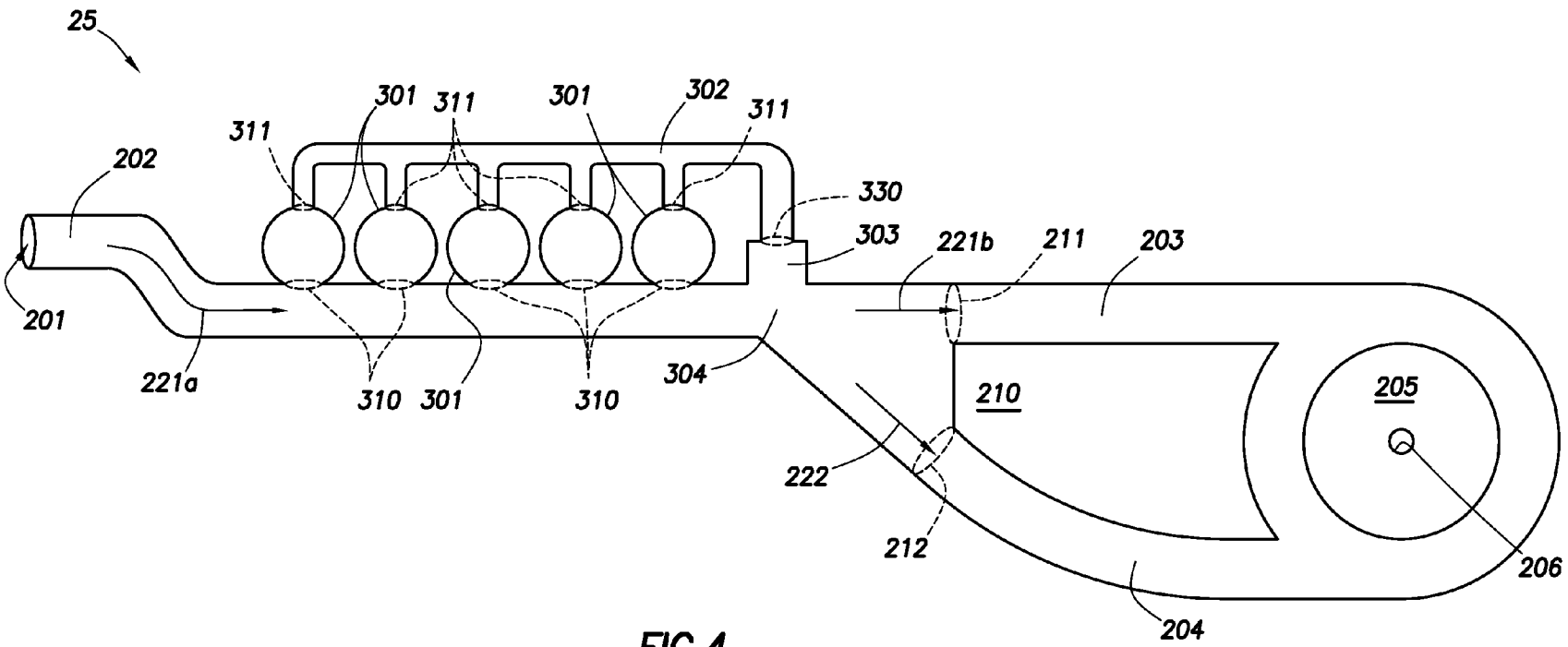
FIG. 4 is a diagram of a flow rate regulator comprising another embodiment of the device for directing the flow of a fluid.

According to an embodiment, the system is a flow rate regulator 25. According to another embodiment, the flow rate regulator is used in a subterranean formation. A flow rate regulator 25 used in a subterranean formation is illustrated in FIG. 4.

Figure 3:
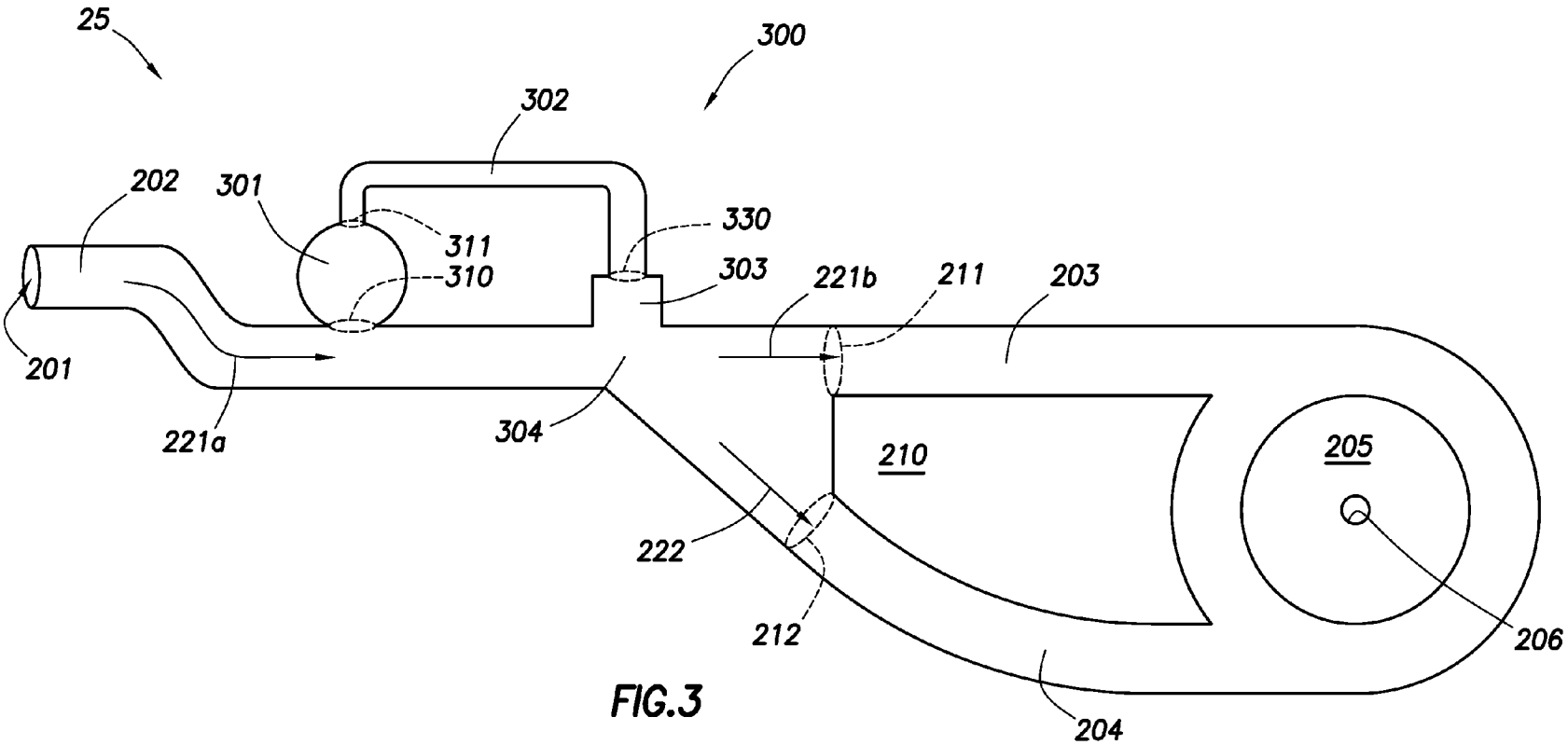
FIG. 3 is a diagram of a flow rate regulator comprising one embodiment of the device for directing the flow of a fluid.

The device for directing the flow of a fluid 300 can include: at least one pressure pocket 301; a first fluid passageway 302; a pressure source 303; and a pressure switch 304. An example of such a device is illustrated in FIG. 3. The device 300 can also include more than one pressure pocket 301. FIG. 4 depicts a device 300 having five pressure pockets 301. If the device 300 includes more than one pressure pocket 301, then the pressure pockets 301 can be connected in series to the second fluid passageway 202. Each of the pressure pockets 301 can also be connected to the first fluid passageway 302. Any discussion of a component of the device 300 and any embodiments regarding the device 300 is meant to apply to the device 300 regardless of the total number of individual components. Any discussion of a particular component of the device 300 (e.g., a pressure pocket 301) is meant to include the singular form of the component and also the plural form of the component, without the need to continually refer to the component in both the singular and plural form throughout. For example, if a discussion involves "the pressure pocket 301," it is to be understood that the discussion pertains to one pressure pocket (singular) and two or more pressure pockets (plural).

Figure 2A:
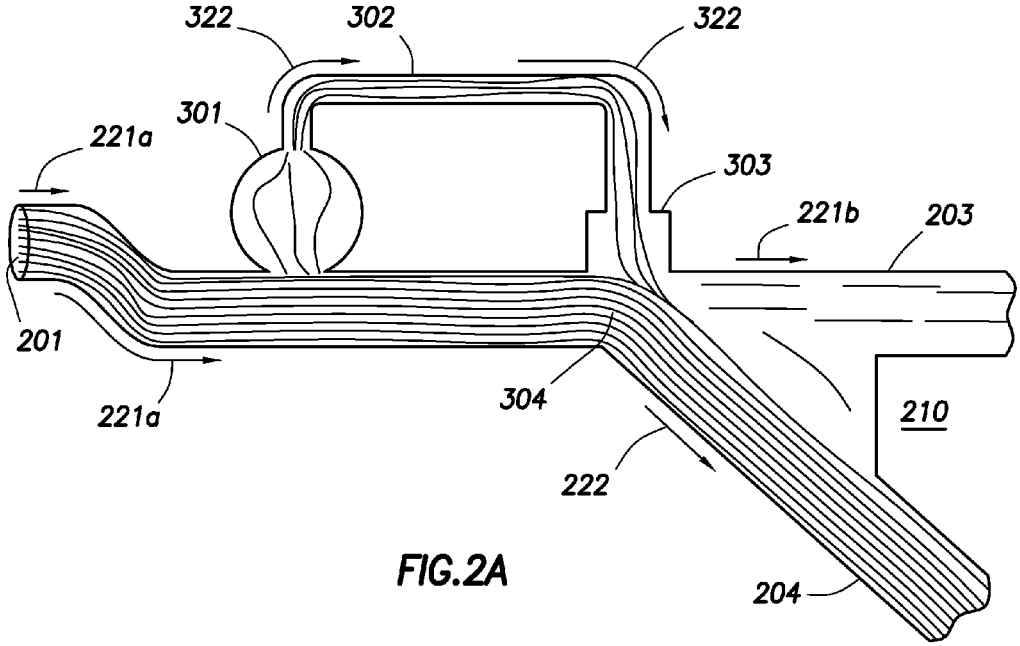
FIG. 2 illustrates a fluid increasingly flowing into one of two different fluid passageways.

The fluid can enter the system and flow through the second fluid passageway 202 in the direction of 221*a*. The fluid traveling in the direction of 221*a* will have a specific flow rate, viscosity, and density. The flow rate, viscosity, or density of the fluid may change. According to an embodiment, the device for directing the flow of a fluid 300 is designed such that depending on at least some of the properties of the fluid, the fluid can increasingly flow into the pressure pocket 301 or the ratio of the fluid entering the pressure pocket 301 can increase. For example, as the flow rate of the fluid decreases, as the viscosity of the fluid increases, or as the density of the fluid decreases, then the fluid increasingly flows into the pressure pocket 301 or the ratio increases. Regardless of the dependent property of the fluid (e.g., the flow rate of the fluid in the second fluid passageway 202, the viscosity of the fluid, or the density of the fluid), as the fluid increasingly flows into the pressure pocket 301 (or the ratio increases), the fluid increasingly flows in the direction of 322 into the first fluid passageway 302. As the fluid increasingly flows into the first fluid passageway 302, the pressure of the pressure source 303 increases. It is to be understood that any discussion of the pressure of the pressure switch is meant to be with respect to the pressure of an adjacent area. For example, the pressure of the pressure source 303 is illustrated in FIG. 1 as $P_1$ and the pressure of the adjacent area is illustrated as $P_2$. As the pressure of the pressure source 303 increases, the pressure switch 304 directs the fluid to increasingly flow in the direction of 222 into the fourth fluid passageway 204. FIG. 2A illustrates fluid flow through the system when the flow rate of the fluid in the second fluid passageway 202 decreases, when the viscosity of the fluid increases, or when the density of the fluid decreases.

Figure 2B:
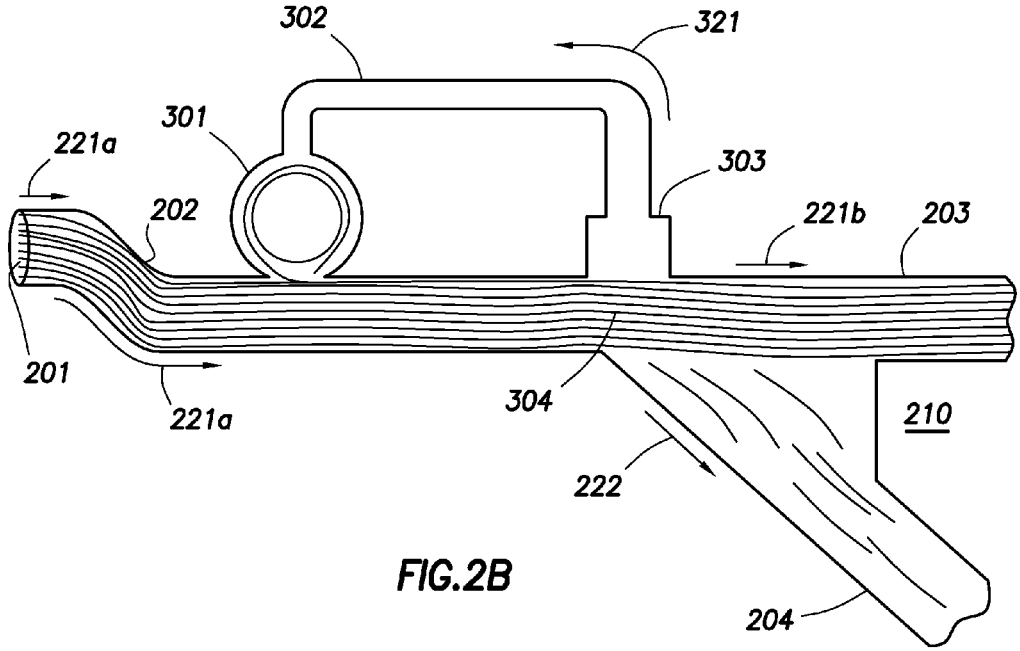

According to another embodiment, as the flow rate of the fluid increases, as the viscosity of the fluid decreases, or as the density of the fluid increases, then the fluid decreasingly flows into the pressure pocket 301 or the ratio decreases. As the fluid decreasingly flows into the pressure pocket 301 (or the ratio decreases), the fluid decreasingly flows into the first fluid passageway 302. As the fluid decreasingly flows into the first fluid passageway 302, the pressure of the pressure source 303 decreases. As the pressure of the pressure source 303 decreases, the pressure switch 304 directs the fluid to increasingly flow in the direction of 221*b* into the third fluid passageway 203. FIG. 2B illustrates fluid flow through the system when the flow rate of the fluid in the second fluid passageway 202 increases, when the viscosity of the fluid decreases, or when the density of the fluid increases. In some instances, the fluid can travel through the first fluid passageway 301 in the direction of 321 and there is a net flow of fluid out of the pressure pocket 301 and into the second fluid passageway 202.

The components of the device for directing the flow of a fluid 300 can be interrelated such that an effect from one component can cause an effect on a different component. By way of example, if the dependent property of the fluid is the flow rate of the fluid in the second fluid passageway 202, then as the flow rate of the fluid in the second fluid passageway 202 decreases, the fluid increasingly flows into the pressure pocket 301, which in turn causes the fluid to increasingly flow into the first fluid passageway 302, which in turn causes the pressure of the pressure source 303 to increase, which in turn causes the pressure switch 304 to direct the fluid to increasingly flow into the fourth fluid passageway 204.

The amount of fluid that enters the pressure pocket 301 can depend on the following: the flow rate of the fluid traveling in the direction of 221*a*; the viscosity of the fluid; the density of the fluid; and combinations thereof. The amount of fluid that enters the pressure pocket can also be a result of the nonlinear effects of the flow rate, viscosity, and density of the fluid. By way of example, as the viscosity of the fluid increases, the fluid increasingly flows into the pressure pocket 301, the fluid increasingly flows into the first fluid passageway 302, the pressure of the pressure source 303 increases, and the pressure switch 304 directs the fluid to increasingly flow in the direction of 222 into the fourth fluid passageway 204. As the viscosity of the fluid decreases, the fluid decreasingly flows into the pressure pocket 301, the fluid decreasingly flows into the first fluid passageway 302, the pressure of the pressure source 303 decreases, and the pressure switch 304 directs the fluid to increasingly flow in the direction of 221*b* into the third fluid passageway 203.

A desired flow rate of a fluid can be predetermined. The predetermined flow rate can be selected based on the type of fluid entering the device. The predetermined flow rate can differ based on the type of the fluid. The predetermined flow rate can also be selected based on at least one of the properties of the fluid entering the device. The at least one of the properties can be selected from the group consisting of the viscosity of the fluid, the density of the fluid, and combinations thereof. For example, depending on the specific application, the desired flow rate of a gas-based fluid may be predetermined to be 150 barrels per day (BPD); whereas, the desired flow rate of an oil-based fluid may be predetermined to be 300 BPD. Of course, one device can be designed with a predetermined flow rate of 150 BPD and another device can be designed with a predetermined flow rate of 300 BPD.

According to an embodiment, the device for directing the flow of a fluid 300 is designed such that when the flow rate of the fluid in a second fluid passageway 302 decreases below the predetermined flow rate, the fluid increasingly flows into the pressure pocket 301 compared to when the flow rate of the fluid in the second fluid passageway increases above the predetermined flow rate. According to another embodiment, the device for directing the flow of a fluid 300 is designed such that when the flow rate of the fluid in a second fluid passageway 302 increases above the predetermined flow rate, the fluid decreasingly flows into the pressure pocket 301 compared to when the flow rate of the fluid in the second fluid passageway decreases below the predetermined flow rate. According to another embodiment, the device for directing the flow of a fluid 300 is designed such that when the viscosity of the fluid decreases below a predetermined viscosity, the fluid decreasingly flows into the pressure pocket 301 compared to when the viscosity of the fluid increases above the predetermined viscosity; and when the viscosity of the fluid increases above the predetermined viscosity, the fluid increasingly flows into the pressure pocket 301 compared to when the viscosity of the fluid decreases below the predetermined viscosity. According to another embodiment, the device for directing the flow of a fluid 300 is designed such that when the density of the fluid decreases below a predetermined density, the fluid increasingly flows into the pressure pocket 301 compared to when the density of the fluid increases above the predetermined density; and when the density of the fluid increases above the predetermined density, the fluid decreasingly flows into the pressure pocket 301 compared to when the density of the fluid decreases below the predetermined density.

According to another embodiment, based on a predetermined flow rate, viscosity or density, the device for directing the flow of a fluid 300 is designed such that when the flow rate of the fluid decreases below, the viscosity increases above, or the density decreases below, more of the fluid flows into the pressure pocket 301 compared to when the flow rate of the fluid increases above, the viscosity decreases below, or the density increases above. According to this embodiment, when more of the fluid flows into the pressure pocket 301, more of the fluid will flow through the first fluid passageway 302 in the direction of 322 compared to when less of the fluid flows into the pressure pocket 301. When more of the fluid flows through the first fluid passageway 302, a pressure of the pressure source 303 is greater than a pressure of an adjacent area (e.g., when $P_1$ is greater than $P_2$). When the pressure of the pressure source 303 is greater than the pressure of an adjacent area, the pressure switch 304 directs the fluid to increasingly flow in the direction of 222 into the fourth fluid passageway 204. According to another embodiment, when the pressure of the pressure source 303 is greater than the pressure of an adjacent area, the pressure switch 304 directs an increasing proportion of the total fluid to flow in the direction of 222 into the fourth fluid passageway 204. In a preferred embodiment, when the pressure of the pressure source 303 is greater than the pressure of an adjacent area, the pressure switch 304 directs a majority of the fluid to flow in the direction of 222 into the fourth fluid passageway 304. As used herein, the term "majority" means greater than 50%. An example of the flow of fluid through the system when the pressure of the pressure source 303 is greater than the pressure of an adjacent area is illustrated in FIG. 2A.

Moreover, when less of the fluid flows into the pressure pocket 301, less of the fluid will flow through the first fluid passageway 302 in the direction of 322 compared to when more of the fluid flows into the pressure pocket 301. When less of the fluid flows through the first fluid passageway 201, a pressure of the pressure source 303 is less than a pressure of an adjacent area (e.g., when $P_1$ is less than $P_2$). Accordingly, when the pressure of the pressure source 303 is less than the pressure of an adjacent area a suction or vacuum can be created in the first fluid passageway 302 and cause the fluid to flow in the direction of 321. When the pressure of the pressure source 303 is less than the pressure of an adjacent area, the pressure switch 304 directs the fluid to increasingly flow in the direction of 221*b* into the third fluid passageway 203. According to another embodiment, when the pressure of the pressure source 303 is less than the pressure of an adjacent area, the pressure switch 304 directs an increasing proportion of the total fluid to flow in the direction of 221*b* into the third fluid passageway 203. In a preferred embodiment, when the pressure of the pressure source 303 is less than the pressure of an adjacent area, the pressure switch 304 directs a majority of the fluid to flow in the direction of 221*b* into the third fluid passageway 203. An example of fluid flow through the system when the pressure of the pressure source 303 is less than the pressure of an adjacent area is illustrated in FIG. 2B.

The device for directing the flow of the fluid 300 is designed to be an independent device, i.e., it is designed to automatically direct the fluid to increasingly flow into either the third or fourth fluid passageway 203 or 204 based on at least the flow rate of the fluid, the viscosity of the fluid, the density of the fluid, and combinations thereof without any external intervention.

Figure 5:
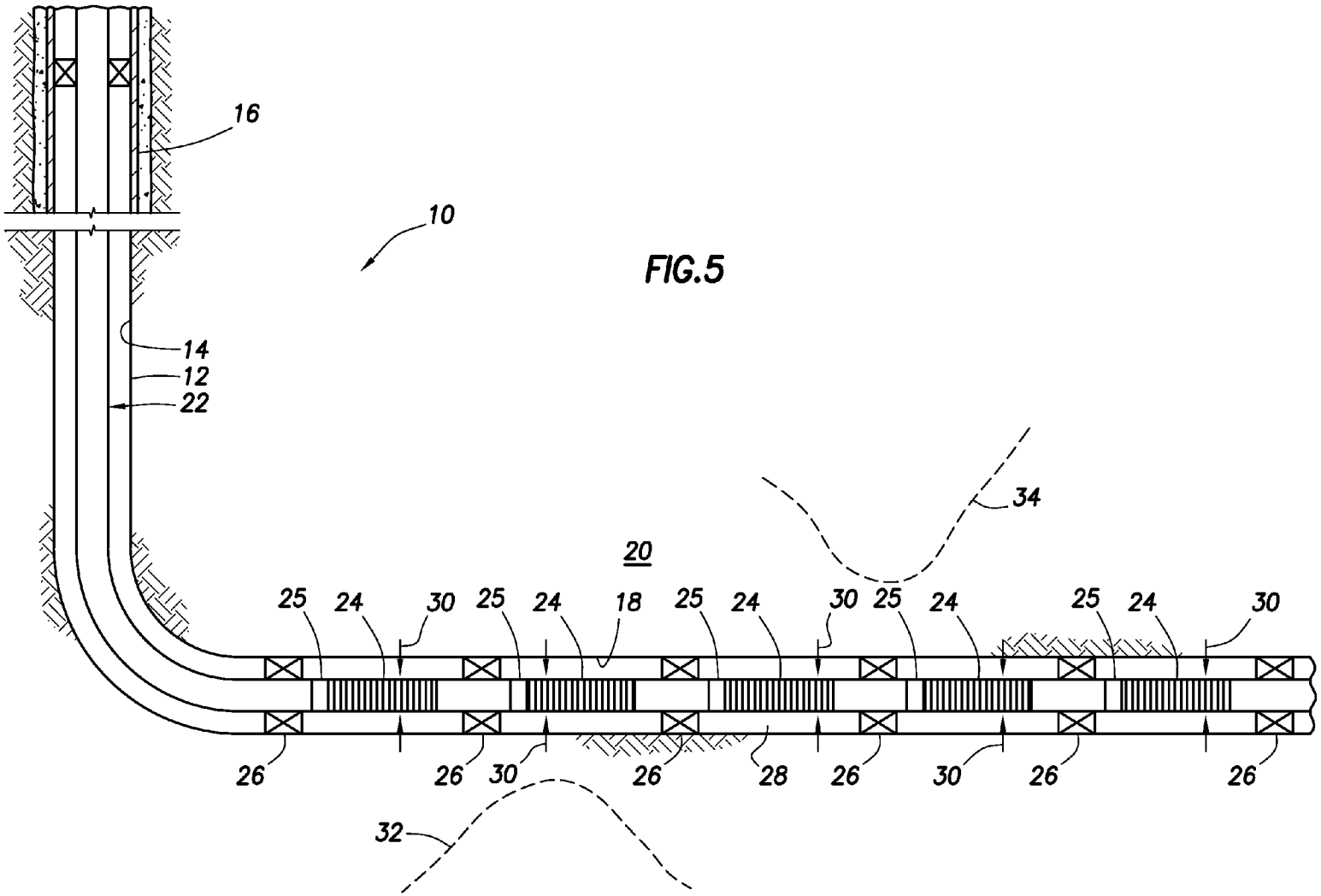
FIG. 5 is a well system containing at least one of the flow rate regulators depicted in FIG. 3 or 4.

FIG. 5 is a well system 10 which can encompass certain embodiments. As depicted in FIG. 5, a wellbore 12 has a generally vertical uncased section 14 extending downwardly from a casing 16, as well as a generally horizontal uncased section 18 extending through a subterranean formation 20. The subterranean formation 20 can be a portion of a reservoir or adjacent to a reservoir.

A tubing string 22 (such as a production tubing string) is installed in the wellbore 12. Interconnected in the tubing string 22 are multiple well screens 24, flow rate regulators 25, and packers 26.

The packers 26 seal off an annulus 28 formed radially between the tubing string 22 and the wellbore section 18. In this manner, a fluid 30 may be produced from multiple zones of the formation 20 via isolated portions of the annulus 28 between adjacent pairs of the packers 26.

Positioned between each adjacent pair of the packers 26, a well screen 24 and a flow rate regulator 25 are interconnected in the tubing string 22. The well screen 24 filters the fluid 30 flowing into the tubing string 22 from the annulus 28. The flow rate regulator 25 regulates the flow rate of the fluid 30 into the tubing string 22, based on certain characteristics of the fluid, e.g., the flow rate of the fluid entering the flow rate regulator 25, the viscosity of the fluid, or the density of the fluid. In another embodiment, the well system 10 is an injection well and the flow rate regulator 25 regulates the flow rate of fluid 30 out of tubing string 22 and into the formation 20.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, cement may be used instead of packers 26 to isolate different zones. Cement may also be used in addition to packers 26.

By way of another example, the wellbore 12 can include only a generally vertical wellbore section 14 or can include only a generally horizontal wellbore section 18. The fluid 30 can be produced from the formation 20, the fluid could also be injected into the formation, and the fluid could be both injected into and produced from a formation.

The well system does not need to include a packer 26. Also, it is not necessary for one well screen 24 and one flow rate regulator 25 to be positioned between each adjacent pair of the packers 26. It is also not necessary for a single flow rate regulator 25 to be used in conjunction with a single well screen 24. Any number, arrangement and/or combination of these components may be used. Moreover, it is not necessary for any flow rate regulator 25 to be used in conjunction with a well screen 24. For example, in injection wells, the injected fluid could be flowed through a flow rate regulator 25, without also flowing through a well screen 24. There can be multiple flow rate regulators 25 connected in fluid parallel or series.

It is not necessary for the well screens 24, flow rate regulator 25, packers 26 or any other components of the tubing string 22 to be positioned in uncased sections 14, 18 of the wellbore 12. Any section of the wellbore 12 may be cased or uncased, and any portion of the tubing string 22 may be positioned in an uncased or cased section of the wellbore, in keeping with the principles of this disclosure.

It will be appreciated by those skilled in the art that it would be beneficial to be able to regulate the flow rate of the fluid 30 entering into the tubing string 22 from each zone of the formation 20, for example, to prevent water coning 32 or gas coning 34 in the formation. Other uses for flow regulation in a well include, but are not limited to, balancing production from (or injection into) multiple zones, minimizing production or injection of undesired fluids, maximizing production or injection of desired fluids, etc.

Referring now to FIGS. 3, 4 and 5, the flow rate regulator 25 can be positioned in the tubing string 22 in a manner such that the fluid 30 enters the first fluid inlet 201 and travels in direction 221*a* through the second fluid passageway 203. For example, in a production well, the regulator 25 may be positioned such that the first fluid inlet 201 is functionally oriented towards the formation 20. Therefore, as the fluid 30 flows from the formation 20 into the tubing string 22, the fluid 30 will enter the first fluid inlet 201. By way of another example, in an injection well, the regulator 25 may be positioned such that the first fluid inlet 201 is functionally oriented towards the tubing string 22. Therefore, as the fluid 30 flows from the tubing string 22 into the formation 20, the fluid 30 will enter the first fluid inlet 201.

An advantage for when the device for directing the flow of a fluid 300 is used in a flow rate regulator 25 in a subterranean formation 20, is that it can help regulate the flow rate of a fluid within a particular zone and also regulate the flow rates of a fluid between two or more zones. Another advantage is that the device 300 can help solve the problem of production of a heterogeneous fluid. For example, if oil is the desired fluid to be produced, the device 300 can be designed such that if water enters the flow rate regulator 25 along with the oil, then the device 300 can direct the heterogeneous fluid to increasingly flow into the third fluid passageway 203 based on the decrease in viscosity of the fluid. The versatility of the device 300 allows for specific problems in a formation to be addressed.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A device for directing the flow of a fluid comprising:
a pressure pocket;
a first fluid passageway;
a pressure source; and
a pressure switch,
wherein the first fluid passageway operationally connects at least the pressure pocket and the pressure source,
wherein the pressure switch is positioned adjacent to the pressure source,
wherein a desired flow rate of a fluid is predetermined, and when the flow rate of the fluid in a second fluid passageway decreases below the predetermined flow rate, the fluid increasingly flows into the pressure pocket compared to when the flow rate of the fluid in the second fluid passageway increases above the predetermined flow rate.

2. The device according to claim 1, wherein the predetermined flow rate of the fluid is selected based on at least one of the properties of the fluid.

3. The device according to claim 2, wherein the at least one of the properties of the fluid is selected from the group consisting of the viscosity of the fluid, the density of the fluid, and combinations thereof.

4. The device according to claim 1, further comprising a branching point and wherein the second fluid passageway branches into a third fluid passageway and a fourth fluid passageway at the branching point.

5. The device according to claim 4, wherein the third and the fourth fluid passageways have a similar back pressure.

6. The device according to claim 4, wherein when the flow rate of the fluid in the second fluid passageway decreases below the predetermined flow rate, a pressure of the pressure source is greater than a pressure of an adjacent area to the pressure source.

7. The device according to claim 6, wherein when the pressure of the pressure source is greater than the pressure of the adjacent area, the pressure switch directs the fluid to increasingly flow into the fourth fluid passageway.

8. The device according to claim 6, wherein when the pressure of the pressure source is greater than the pressure of the adjacent area, the pressure switch directs a majority of the fluid to flow into the fourth fluid passageway.

9. The device according to claim 4, wherein when the flow rate of the fluid in the second fluid passageway increases above the predetermined flow rate, a pressure of the pressure source is less than a pressure of the adjacent area.

10. The device according to claim 9, wherein when the pressure of the pressure source is less than the pressure of the adjacent area, the pressure switch directs the fluid to increasingly flow into the third fluid passageway.

11. The device according to claim 9, wherein when the pressure of the pressure source is less than the pressure of the adjacent area, the pressure switch directs a majority of the fluid to flow into the third fluid passageway.

12. A device for directing the flow of a fluid, wherein the fluid has a plurality of properties, the device comprises:
a pressure pocket;
a first fluid passageway;
a second fluid passageway;
a third fluid passageway;
a fourth fluid passageway, wherein the second fluid passageway branches into the third and fourth fluid passageways;
a pressure source; and
a pressure switch, wherein the pressure source is located between the first fluid passageway and the pressure switch,
wherein the first fluid passageway operationally connects at least the pressure pocket and the pressure source,
wherein as at least one of the properties of the fluid changes, the amount of fluid flowing in the first fluid passageway changes;
wherein as the amount of fluid flowing in the first fluid passageway changes, the pressure of the pressure source changes; and
wherein as the pressure of the pressure source changes, the pressure switch directs the fluid to increasingly flow into the third fluid passageway or the fourth fluid passageway.

13. The device according to claim 12, wherein the fluid is homogenous.

14. The device according to claim 12, wherein the fluid is heterogeneous.

15. The device according to claim 12, wherein the device is used in a flow rate regulator.

16. The device according to claim 12, wherein depending on at least one of the properties of the fluid, the amount of fluid that flows into the pressure pocket changes.

17. The device according to claim 16, wherein the at least one of the properties of the fluid are selected from the group consisting of the flow rate of the fluid in the second fluid passageway, the viscosity of the fluid, and the density of the fluid.

18. The device according to claim 17, wherein the shape of the pressure pocket is selected such that: as the flow rate of the fluid in the second fluid passageway decreases, the fluid increasingly flows into the pressure pocket; and as the flow rate of the fluid in the second fluid passageway increases, the fluid decreasingly flows into the pressure pocket.

19. The device according to claim 17, wherein the shape of the pressure pocket is selected such that: as the viscosity of the fluid increases, the fluid increasingly flows into the pressure pocket; and as the viscosity of the fluid decreases, the fluid decreasingly flows into the pressure pocket.

20. The device according to claim 17, wherein the shape of the pressure pocket is selected such that: as the density of the fluid decreases, the fluid increasingly flows into the pressure pocket; and as the density of the fluid increases, the fluid decreasingly flows into the pressure pocket.

21. The device according to claim 17, further comprising a branching point, wherein the second fluid passageway branches into the third fluid passageway and the fourth fluid passageway at the branching point.

22. The device according to claim 21, wherein the third and fourth fluid passageways have a similar back pressure.

23. The device according to claim 17, wherein as the flow rate of the fluid in the second fluid passageway decreases, the fluid increasingly flows into the pressure pocket; and as the flow rate of the fluid in the second fluid passageway increases, the fluid decreasingly flows into the pressure pocket.

24. The device according to claim 23, wherein as the fluid increasingly flows into the pressure pocket, the fluid increasingly flows into the first fluid passageway.

25. The device according to claim 24, wherein as the fluid increasingly flows into the first fluid passageway, the pressure from the pressure source increases.

26. The device according to claim 25, wherein as the pressure from the pressure source increases, the pressure switch directs the fluid to increasingly flow into the fourth fluid passageway.

27. The device according to claim 23, wherein as the fluid decreasingly flows into the pressure pocket, the fluid decreasingly flows into the first fluid passageway.

28. The device according to claim 27, wherein as the fluid decreasingly flows into the first fluid passageway, the pressure from the pressure source decreases.

29. The device according to claim 28, wherein as the pressure from the pressure source decreases, the pressure switch directs the fluid to increasingly flow into the third fluid passageway.

30. The device according to claim 17, wherein as the viscosity of the fluid increases, the fluid increasingly flows into the pressure pocket; and as the viscosity of the fluid decreases, the fluid decreasingly flows into the pressure pocket.

31. The device according to claim 30, wherein as the fluid increasingly flows into the pressure pocket, the fluid increasingly flows into the first fluid passageway.

32. The device according to claim 31, wherein as the fluid increasingly flows into the first fluid passageway, the pressure from the pressure source increases.

33. The device according to claim 32, wherein as the pressure from the pressure source increases, the pressure switch directs the fluid to increasingly flow into the fourth fluid passageway.

34. The device according to claim 30, wherein as the fluid decreasingly flows into the pressure pocket, the fluid decreasingly flows into the first fluid passageway.

35. The device according to claim 34, wherein as the fluid decreasingly flows into the first fluid passageway, the pressure from the pressure source decreases.

36. The device according to claim 35, wherein as the pressure from the pressure source decreases, the pressure switch directs the fluid to increasingly flow into the third fluid passageway.

37. The device according to claim 17, wherein as the density of the fluid decreases, the fluid increasingly flows into the pressure pocket; and as the density of the fluid increases, the fluid decreasingly flows into the pressure pocket.

38. The device according to claim 37, wherein as the fluid increasingly flows into the pressure pocket, the fluid increasingly flows into the first fluid passageway.

39. The device according to claim 38, wherein as the fluid increasingly flows into the first fluid passageway, the pressure from the pressure source increases.

40. The device according to claim 39, wherein as the pressure from the pressure source increases, the pressure switch directs the fluid to increasingly flow into the fourth fluid passageway.

41. The device according to claim 37, wherein as the fluid decreasingly flows into the pressure pocket, the fluid decreasingly flows into the first fluid passageway.

42. The device according to claim 41, wherein as the fluid decreasingly flows into the first fluid passageway, the pressure from the pressure source decreases.

43. The device according to claim 42, wherein as the pressure from the pressure source decreases, the pressure switch directs the fluid to increasingly flow into the third fluid passageway.

44. A flow rate regulator comprises:

a device for directing the flow of a fluid comprising:

(i) a pressure pocket;

(ii) a first fluid passageway;

(iii) a pressure source; and (iv) a pressure switch, wherein the first fluid passageway operationally connects at least the pressure pocket and the pressure source, and wherein the pressure switch is positioned adjacent to the pressure source, a second fluid passageway;

a third fluid passageway; and a fourth fluid passageway, wherein the second fluid passageway branches into the third and fourth fluid passageways, wherein as at least one of the properties of the fluid changes, the amount of fluid that flows into the pressure pocket changes whereby:

(a) as the flow rate of the fluid in the second fluid passageway changes, the amount of fluid that flows into the pressure pocket changes inversely;

(b) as the viscosity of the fluid in the second fluid passageway changes, the amount of fluid that flows into the pressure pocket changes similarly; or (c) as the density of the fluid in the second fluid passageway changes, the amount of fluid that flows into the pressure pocket inversely changes, wherein the change in the amount of fluid that flows in the pressure pocket causes a change in the pressure from the pressure source, wherein as the pressure from the pressure source increases, the pressure switch directs the fluid to increasingly flow into the fourth fluid passageway, and wherein as the pressure from the pressure source decreases, the pressure switch directs the fluid to increasingly flow into the third fluid passageway.

45. The regulator according to claim 44, wherein the flow rate regulator is used in a subterranean formation.

* * * * *